United States Patent [19]

Jarman et al.

[11] Patent Number: 4,457,159

[45] Date of Patent: Jul. 3, 1984

[54] SHEET METAL PULL CLAMP

[76] Inventors: Davis R. Jarman, 612 Ward Dr.; Virgil H. Hinson, 206 Fairway Oaks Dr., both of Brunswick, Ga. 31520

[21] Appl. No.: 409,313

[22] Filed: Aug. 18, 1982

[51] Int. Cl.[3] ..... B21D 1/12

[52] U.S. Cl. ..... 72/422; 72/705; 24/134 P; 269/234; 294/116

[58] Field of Search ..... 72/290, 422, 705; 294/116, 86.29, 136, 86.3, 86.31; 254/22, 24; 269/238, 229, 234; 24/134 N, 134 P, 248 E, 263 SW, 137 A, 251

[56] References Cited

U.S. PATENT DOCUMENTS

| | | | |
|---|---|---|---|
| 902,795 | 11/1908 | Appleton | 24/503 |
| 2,989,337 | 6/1961 | Pispisa | 269/238 |
| 3,355,777 | 12/1967 | Mojelski | 72/705 |
| 3,744,838 | 7/1973 | Jackson | 72/705 |
| 3,879,814 | 4/1975 | Mojelski | 294/116 |
| 3,955,249 | 5/1976 | Shiozaki | 72/705 |
| 3,986,746 | 10/1976 | Chartier | 72/705 |
| 4,037,456 | 7/1977 | Jarman | 72/705 |
| 4,148,210 | 4/1979 | Bjork | 72/705 |

FOREIGN PATENT DOCUMENTS

| | | | |
|---|---|---|---|
| 341953 | 12/1959 | Switzerland | 269/234 |

*Primary Examiner*—Lowell A. Larson
*Attorney, Agent, or Firm*—Harvey B. Jacobson

[57] ABSTRACT

A pair of elongated clamp levers are provided and interconnected intermediate their opposite ends for substantially coplanar relative oscillation of the levers to inversely swing corresponding pairs of ends of the levers toward and away from each other. One pair of lever ends defines opposing jaw ends between which a sheet metal marginal portion may be clamped and a wedge assembly is moveably connected between the other pair of ends of the levers and includes operating structure moveable lengthwise of the levers and to which one end of an elongated pull member may be anchored. The wedge assembly, when the operating structure is displaced away from the jaw ends of the levers, is operative to spread the other pair of ends of the levers apart, the operating structure being effective to apply a high wedging force-to-pull force ratio during initial movement of the operating structure away from the jaw ends of the levers and to progressively diminish the aforementioned ratio as the operating structure is displaced further away from the jaw ends of the levers.

6 Claims, 6 Drawing Figures

SHEET METAL PULL CLAMP

BACKGROUND OF THE INVENTION

In the auto body repair business it is often necessary to clampingly engage and pull upon a section of vehicle body sheet metal in order to assist in straightening the same. Accordingly, many different forms of pull clamps heretofore have been devised for this purpose. However, many of these previously known forms of pull clamps are either time consuming to install and remove, do not afford sufficient clamping action or tend to exert a clamping action which automatically increases an excessive amount as the pull on the clamp to straighten the associated sheet metal panel is increased. Accordingly, a need exists for an improved form of pull clamp which may be readily installed and removed, automatically actuated to apply a sufficient clamping action to prevent slippage and operative to progressively decrease the clamp force-to-pull ratio as the pull on the clamp is increased.

Examples of previously known forms of pull clamps including some of the general structural and operational features of the instant invention are disclosed in U.S. Pat. Nos. 1,457,104, 3,355,777, 3,744,838, 3,827,279, and 3,955,249.

BRIEF DESCRIPTION OF THE INVENTION

The pull clamp of the instant invention includes a pair of elongated generally parallel levers interconnected by fulcrum means intermediate their opposite ends for relative coplanar oscillation of the levers to inversely swing remote pair of jaw ends toward and away from each other. One pair of ends comprise jaw ends and wedge structure is operative connected between the ends of the levers remote from the jaw ends and includes operator structure shiftable longitudinally of the levers and to which one end of an elongated pull member may be anchored.

The wedge structure is operative to affect a high wedging force-to-pull force ratio for wedging the ends of the levers remote from the jaw ends away from each other upon initial movement of the operator structure away from the jaw ends and to progressively diminish the aforementioned ratio as the operator structure moves further away from the jaw ends of the levers. In this manner, ample initial clamping action is provided upon initial tensioning of the associated pull member and the clamping action of the clamp is increased at a diminishing rate as the tension on the corresponding pull member is progressively increased.

The main object of this invention is to provide a pull clamp which may be effectively utilized in applying a pull to a vehicle body sheet metal section which is to be straightened.

Another object of this invention is to provide a pull clamp constructed in a manner enabling it to be readily applied to and disengaged from an associated sheet metal panel.

Yet another object of this invention is to provide a pull clamp of the automatic clamp action increasing type and yet constructed in a manner whereby the rate of increase of the clamping action will decrease as the amount of pull on the clamp is increased.

A final object of this invention to be specifically enumerated herein is to provide a pull clamp in accordance with the preceding objects and which will conform to conventional forms of manufacture, will be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
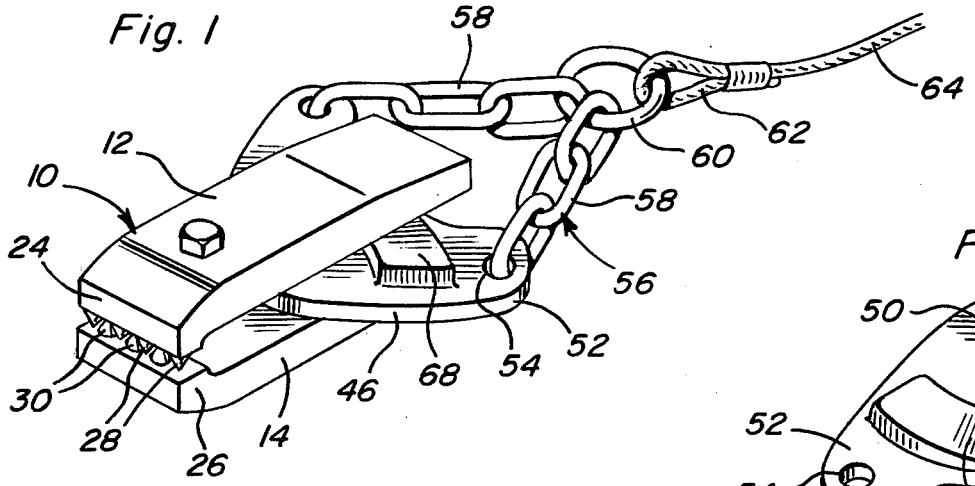
FIG. 1 is a perspective view of the pull clamp.
Figure 6:
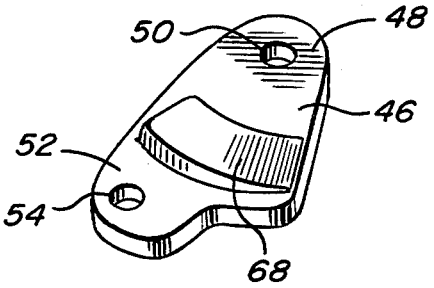
FIG. 6 is a perspective view of one of the operator wedges of the clamp.

Referring now more specifically to the drawings the numeral 10 generally designates the clamp of the instant invention. The clamp 10 includes a pair of elongated generally parallel force levers 12 and 14 including corresponding jaw ends 16 and 18 and moment arm ends 20 and 22. The jaw ends 16 and 18 include opposing jaw faces 24 and 26 in which conical work piece gripping members 28 and 30 are removeably threadedly anchored.

The levers 12 and 14 additionally include registered transverse bores 32 and 34 formed therethrough and a fulcrum defining bolt type fastener 36 is removeably secured through the bores 30 and 34. The fastener 36 is loosely received in the bores 32 and 34 and, accordingly, the levers 12 and 14 may be effectively relatively oscillated about an axis extending transversely of the levers and the fastener 36.

The intermediate length portions of the levers 12 and 14 on the sides of the bores 32 and 34 remote from the jaw faces 24 and 26 have opposing recesses 38 and 40 formed therein and the opposite ends of an anchor shaft 42 are loosely received in the recesses 38 and 40. Further, a pair of cam levers 44 and 46 are provided and are received between the moment arm ends 20 and 22 of the levers 12 and 14. The cam levers 44 and 46 include base ends 48 having registered bores 50 formed therethrough and the end portions of the shaft 42 are loosely received through the bores 50. In this manner, the cam levers 44 and 46 are pivotally anchored between the moment arm ends 20 and 22 of the levers 12 and 14. The cam levers 44 and 46 also include free ends 52 through which bores 54 are formed and an operating bridle referred to in general by the reference numeral 56 is provided an includes a pair of link chain sections 58 having one pair of ends anchored through the bores 54 and the other pair of ends anchored relative to a pull ring 60 to which one end 62 of a tension member 64 is anchored.

The mid portions of the cam levers 44 and 46 include transversely extending arcuate wedge ramps 66 and 68 supported therefrom and the wedge ramps 66 and 68 oppose each other.

Figure 2:
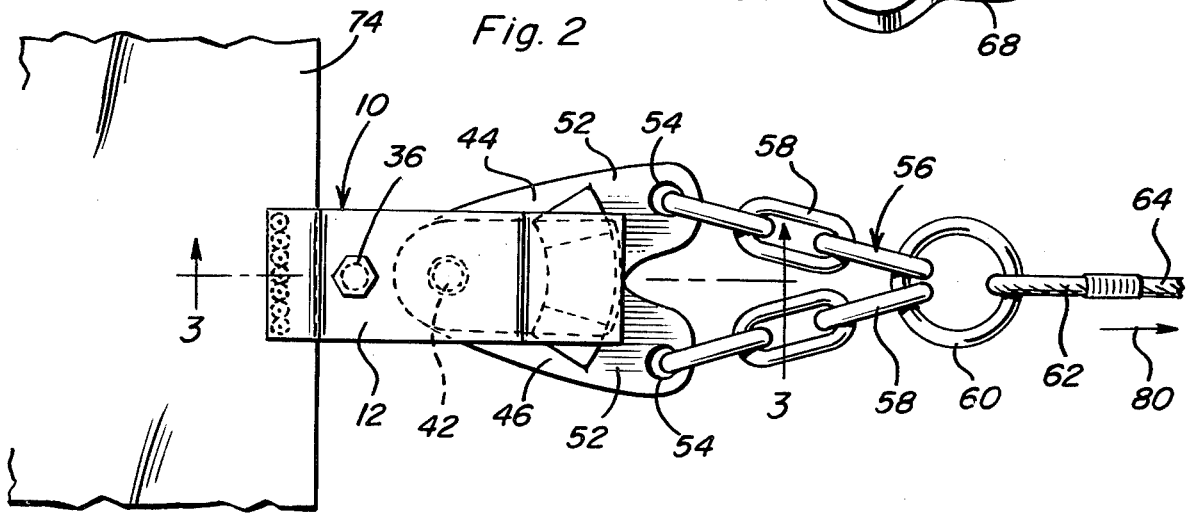
FIG. 2 is a top plan view of the pull clamp in use.
Figure 3:
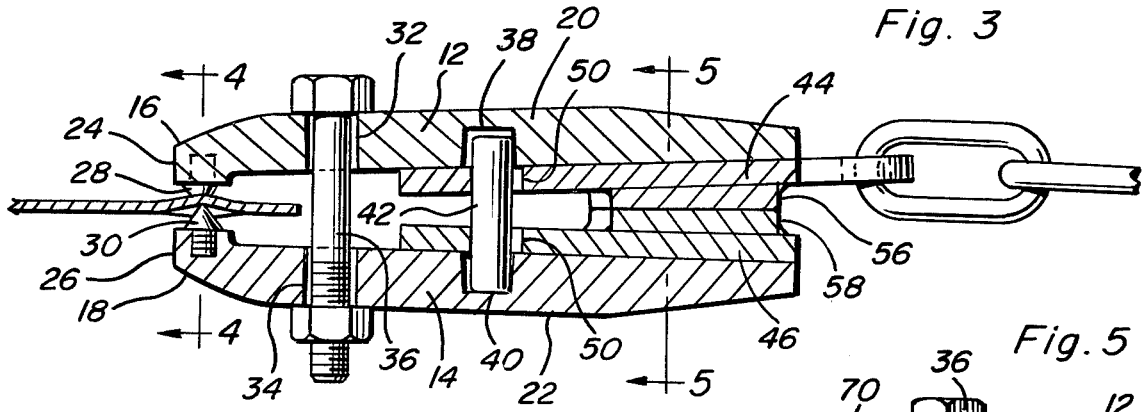
FIG. 3 is an enlarged longitudinal vertical sectional view taken substantially upon the plane indicated by the section line 3—3 of FIG. 2.
Figure 4:
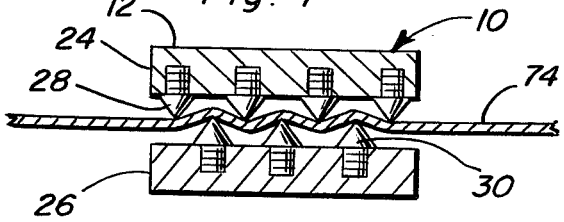
FIG. 4 is a transverse sectional view taken substantially upon the plane indicated by the section line 4—4 of FIG. 3.
Figure 5:
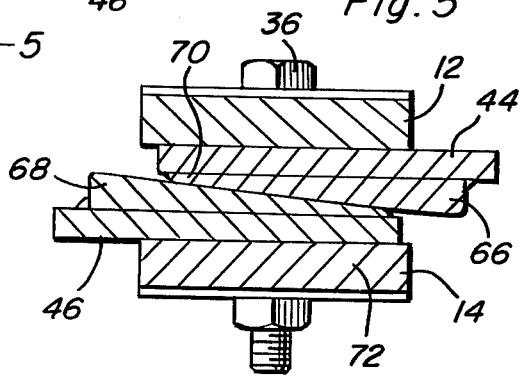
FIG. 5 is a transverse sectional view taken substantially upon the plane indicated by the section line 5—5 of FIG. 3.

When the free ends 52 are spread apart in the manner illustrated in FIG. 1 of the drawings the toe or leading ends 70 and 72 of the wedge ramps 66 and 68 are disposed in slightly overlapped relation and swinging movement of the free ends 52 toward each other to the positions thereof illustrated in FIG. 2 causes the overlap of the wedge ramps 66 and 68 to be increased in the manner illustrated in FIG. 5 of the drawings whereby the moment arm ends 20 and 22 of the levers 12 and 14 are spread apart, thus causing the jaw faces 24 and 26 to be swung toward each other and the gripping elements 28 and 30 to tightly grip a sheet metal panel 74 disposed therebetween.

From a comparison of FIGS. 1 and 2 it will be noted that as the free ends 52 of the cam levers 44 and 46 are swung from the spread apart positions thereof illustrated in FIG. 1 toward the closely spaced apart positions thereof illustrated in FIG. 2 as a result of a pull on the tension member 64 in the direction of the arrow 80 in FIG. 2, the effective lever arms represented by the cam levers 44 and 46 diminish in length. In this manner, as the operating bridle 56 is displaced away from the jaw ends 16 and 18 the ratio of the clamping action of the jaw ends 16 and 18 on the sheet metal section 74 relative to the pull on the tension member 64 in the direction of the arrow 80 gradually diminishes. Thus, after an initial secure clamping action is affected on the sheet metal panels 74 by the jaws 16 and 18 upon initial rearward displacement of the operating bridle 56 away from the jaws 16 and 18 the ratio of the clamping action of the jaws 16 and 18 on the sheet metal panel 74 relative to the pull on the tension member 64 gradually diminishes and a considerable pull may be applied to the tension member 64 without overly clamping the jaws 16 and 18 on the sheet metal panel 74.

It is pointed out that while the wedge ramps 66 and 68 are mounted on the opposing sides of the cam levers 44 and 46, the wedge ramps 66 and 68 could be mounted on the remote sides of the cam levers 46 and 48. Also, the levers 12 and 14 could be pivotally interconnected by the utilization of a transverse pivot pin rather than the fulcrum defining fastener 36. However, the fastener 36 is preferred in as much as simple tightening or loosening of the fastener 36 readily adapts the clamp 10 to be clampingly engaged with thinner and thicker sheet metal panels, respectively.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sheet metal pull clamp including a pair of elongated generally parallel force levers, connecting means in the form of an adjustable length shank-type fastener extending and loosely secured through corresponding portions of said levers intermediate their opposite ends for substantially coplanar oscillation of said levers relative to each other to inversely swing the pairs of corresponding lever ends toward and away from each other, one pair of corresponding ends of said levers defining jaw ends between which sheet metal marginal edge portions may be gripped, the other pair of corresponding ends of said levers defining moment arm ends, a pair of cam levers including corresponding base and free ends, pivot means pivotally mounting said base ends between and from said moment arm ends for relative angular displacement of said cam levers about an axis generally paralleling said shank-type fasteners between first positions with said free ends of said cam levers divergent from opposite sides of a plane containing said force levers and second positions with said free ends swung toward the last mentioned plane, a pair of elongated tension member sections having first and second end portions, said first end portions being anchored to said free ends of said cam levers and said second end portions being adapted to have force applied thereto for displacing said second ends away from said jaws ends of said force levers, said cam levers and moment arm ends including a first set of juxtaposed surfaces and said cam levers defining a second set of juxtaposed surfaces, at least one of said sets of juxtaposed surfaces including coacting wedge surfaces spaced inward of the terminal ends of said moment arm ends for wedging said moment arm ends apart responsive to swinging of said cam levers toward said second positions thereof, said base ends of said cam levers having registered bores formed therethrough, said pivot means pivotably connecting said base ends of said cam levers between and from the moment arm ends of said force levers including opposing recesses formed in said moment arm ends and a pivot shaft extending between and having its opposite ends seated in said recesses with intermediate length portions of said pivot shaft being rotatably received through said registered bores, said pivot shaft also interconnecting said force levers against angular displacement relative to each other about said shank-type fastener.

2. The pull clamp of claim 1 wherein said coacting wedge surfaces project outwardly of said first set of juxtaposed surfaces.

3. The pull clamp of claim 1 wherein said jaw ends include replaceable gripping elements supported therefrom and the gripping elements on each jaw end are staggered relative to the gripping elements on the other jaw end.

4. The pull clamp of claim 3 wherein said gripping element and said jaw ends include means removeably supporting said gripping elements from said jaw ends.

5. The pull clamp of claim 1 wherein said coacting wedge surfaces extend longitudinally in arcuate paths having the axis having said pivot shaft as their centers of curvature.

6. The pull clamp of claim 1 wherein said second end portions of said tension member sections are joined by an anchor structure to which one end of a tension member may be secured.

* * * * *